US006367163B1

(12) United States Patent
Luker

(10) Patent No.: US 6,367,163 B1
(45) Date of Patent: Apr. 9, 2002

(54) HOT AIR DRYER

(76) Inventor: William A. Luker, 15206 E. Crystal Dr., Burnsville, MN (US) 55306

( * ) Notice: Subject to any disclaimer, the term of this patent is extended or adjusted under 35 U.S.C. 154(b) by 0 days.

(21) Appl. No.: 09/519,368

(22) Filed: Mar. 6, 2000

Related U.S. Application Data

(60) Provisional application No. 60/140,949, filed on Jun. 28, 1999.

(51) Int. Cl.[7] ..... F26B 11/12

(52) U.S. Cl. ..... 34/182; 34/183; 34/165; 432/239

(58) Field of Search ..... 34/182, 183, 165; 432/107, 108, 109, 110, 117, 118, 239

(56) References Cited

U.S. PATENT DOCUMENTS 4,214,376 A * 7/1980 Lucke et al. ..... 34/182
4,276,701 A * 7/1981 Takacs et al. ..... 34/182
4,354,317 A * 10/1982 Mathis et al. ..... 34/182
5,570,517 A 11/1996 Luker

* cited by examiner

*Primary Examiner*—Jiping Lu
(74) *Attorney, Agent, or Firm*—Peter Forest, Esq.; Robert W. Gutenkauf, Esq.; Malcolm D. Reid, Esq.

(57) ABSTRACT

A hot air slurry dryer having a cylindrical housing with a central shaft rotatably mounted in the housing. Material to be dried moves from an upstream end of the housing to an outlet at a downstream end. A hot air inlet is connected to the upstream end of the housing preferably at an upstream end wall. A material inlet is open to the side wall of the housing downstream of the hot air inlet. The shaft carries structure for breaking up the moist material introduced into the housing and mixing it with the hot air. In a preferred embodiment a drum is carried by the shaft at the inlet end of the cylindrical housing. The drum carries a plurality of agitator blades that pass close by the interior surface of the side wall of the housing.

12 Claims, 3 Drawing Sheets

HOT AIR DRYER

CROSS REFERENCE TO A RELATED APPLICATION

This application claims the benefit of the U.S. Provisional Patent Application Ser. No. 60/140,949 filed Jun. 28, 1999.

BACKGROUND OF THE INVENTION

A hot air dryer with a cylindrical housing is shown and described in U.S. Pat. No. 5,570,517 issued Nov. 5, 1996 the disclosure of which is incorporated herein by reference. That dryer has a cylindrical housing. A rotatable shaft extends through the housing. The housing has an inlet end for admitting material to be dried and hot air to dry it. The inlet end of the shaft carries disks that carry scraper blades. The scraper blades are mounted to scrape the inside wall of the housing. The last upstream disk carries end wall scraper blades that scrape the inlet end wall of the housing. The scraper blades prevent material that enters the housing from adhering and remaining on the side and end wall of the housing. The remainder of the shaft carries retention paddles. Shaft mounted and wall mounted air dams are located along the length of the housing. A discharge opening is at the outlet end of the housing for discharge of material that is drier than it was when it entered the inlet end.

The end wall scrapers are necessitated by the location of the material inlet at the end wall of the housing. Material tends to collect on the end wall and must be removed. Elimination of these end wall and side wall scrapers is desirable in terms of simplifying the structure and reducing maintenance requirements.

In addition, material tends to accumulate between the disks. This material will eventually dry and, in some instances, burn. Elimination of this accumulation region is desirable.

SUMMARY OF THE INVENTION

The invention pertains to an improved hot air material or slurry dryer of the type discussed above but wherein a product inlet is connected to the side of the cylindrical housing as opposed to the end wall. The end wall is no longer a problem in terms of the formation of a build-up of material that needs to be removed. In one preferred embodiment a drum is mounted toward the upstream end of the shaft. The drum carries a plurality of agitator blades to agitate the incoming material to dry it. The agitator blades can be arranged in a spiral pattern about the drum in order to influence downstream movement of subject material. Retention paddles can be mounted along the remainder of the shaft.

IN THE DRAWINGS

DESCRIPTION OF A PREFERRED EMBODIMENT

Figure 1:
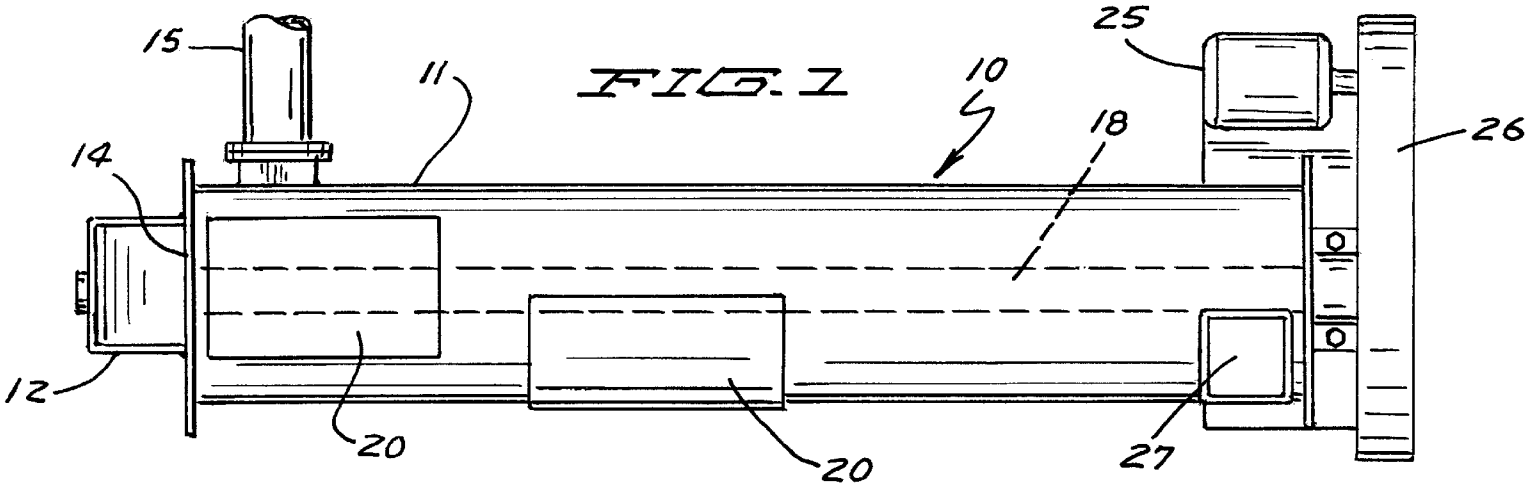
FIG. 1 is a top plan view of a dryer according to the invention.

A dryer according to a preferred embodiment of the present invention is similar in many respects to the dryer shown and described in U.S. Pat. No. 5,570,517 referenced above. One of the significant differences is that the dryer of the present invention has a material inlet on the side of the dryer housing as opposed to being located on the inlet end wall. Problems with respect to the introduction of material at the inlet end wall are eliminated.

A dryer of the present invention is indicated at 10 in the drawings, and includes an elongate cylindrical dryer housing 11 supported on a stand or frame 13 and having a drying chamber 17. The inlet or upstream end of the dryer is on the left in FIGS. 1 and 2. A hot air duct 12 is connected to the upstream end wall 14 of housing 11 for introduction of hot air into the drying chamber 17. Hot air duct 14 connects to a suitable hot air source such as a furnace (not shown).

A material inlet is connected to the side of the dryer housing 11 and open to chamber 17. The material inlet is located to introduce wet material usually in a slurry form, into the dryer housing downstream of the upstream end wall 14. A material inlet fitting 15 is attached to the side of the dryer housing 11 and open to chamber 17 at a material inlet opening 15A. A material inlet pipe 16 is connected to the inlet fitting 15. The other end of the material inlet pipe 16 is connected to a supply of material to be dried. An auger (not shown) can optionally be mounted in the inlet pipe 16 for movement of wet material into the dryer housing 11.

A shaft 18 is centrally mounted in housing 11 along the longitudinal axis thereof for axial rotation. An upstream outboard end 19 of shaft 18 extends out of dryer housing 11 through inlet end wall 14. The end 19 of shaft 18 is supported by a pillow block bearing 21. The opposite or downstream end 22 of shaft 19 outboard of an outlet end wall 23 of dryer housing 11 is supported by another pillow block bearing 24.

Figure 3:
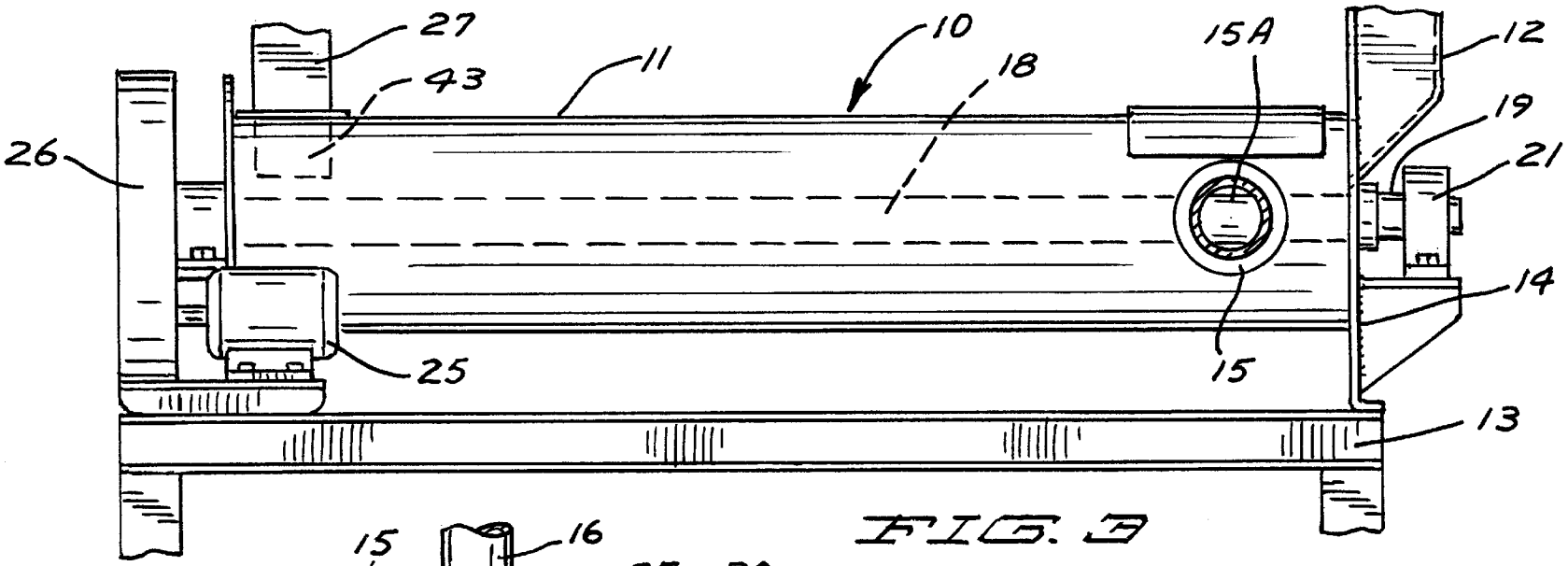
FIG. 3 is side elevational view of the dryer of FIG. 1 showing the side opposite that shown in FIG. 2.
Figure 4:
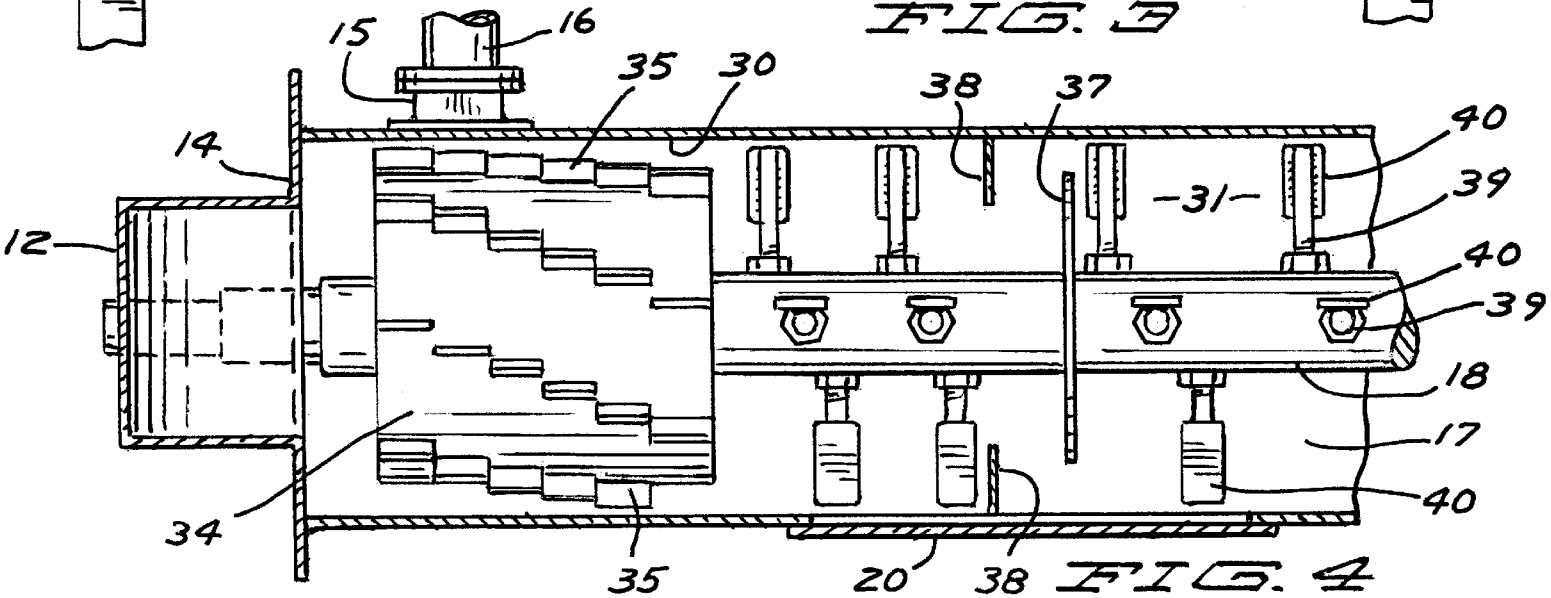
FIG. 4 is an enlarged sectional view of a portion of the dryer of FIG. 2 taken along the line 4—4 thereof.

Shaft 18 is rotated by an electric motor assembly. An electric motor 25 is shown in FIGS. 1 and 3 along with a drive housing 26. Motor 25 is connected to the downstream outboard end of shaft 18 by suitable conventional drive means such as a drive belt or drive chain contained within drive housing 26.

Figure 2:
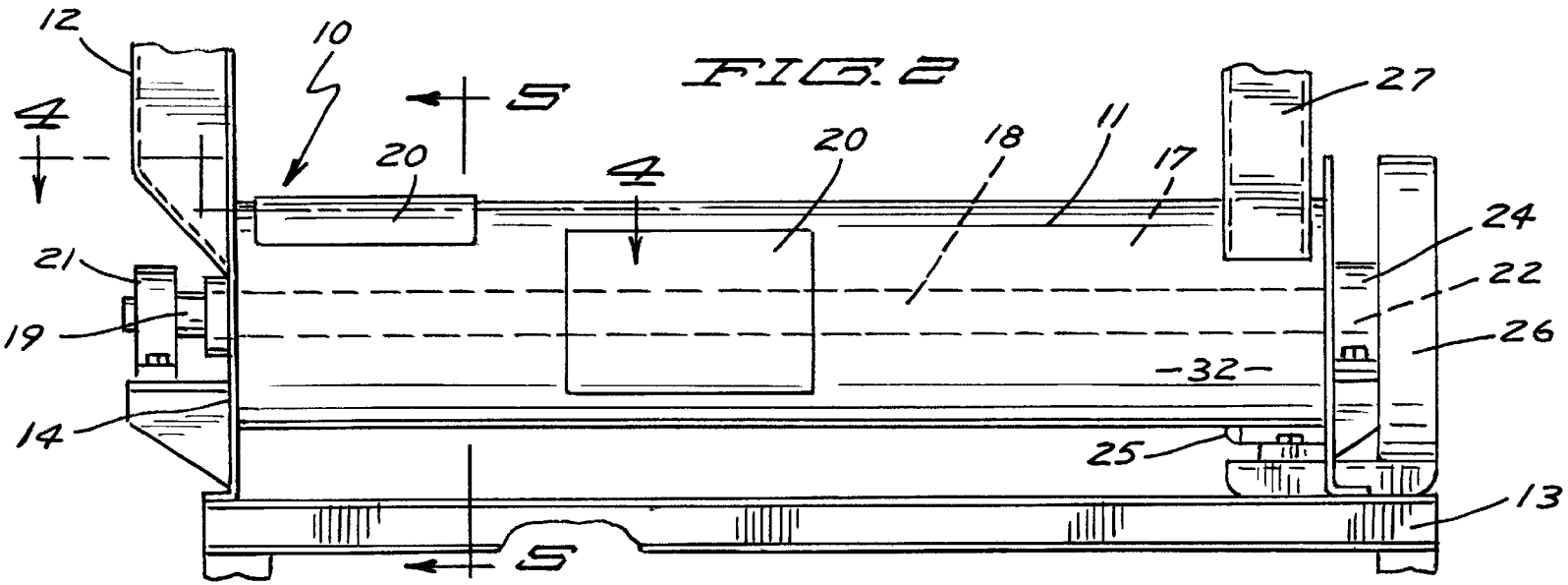
FIG. 2 is a side elevational view of the dryer shown in FIG. 1.

FIGS. 2 and 3 show a material outlet pipe or duct 27 extending from the side of dryer housing 11 proximate the outlet or downstream end thereof. Outlet duct can be connected to apparatus for further processing such as a cyclone separator.

The chamber 17 of housing 11 includes an inlet zone 30, a retention zone 31 and a discharge zone 32. A cylindrical drum 34 is mounted to the shaft 18 in the inlet zone of chamber 17. The diameter of drum 34 is somewhat larger than that of shaft 19 and spans most of the diameter of the chamber 17. Drum 34 is positioned in intercepting relationship to the inlet opening 15A to chamber 17. Wet and lumpy material entering the inlet zone of dryer housing 11 first encounters drum 34.

Drum 34 carries a plurality of agitator blades 35. Agitator blades 35 sweep close by the interior side wall surface of the inlet zone of dryer housing 11. Agitator blades 35 break up the incoming slurry material and prevent wet material from adhering to the inside surface of housing 11. In a preferred embodiment the agitator blades are arranged in a spiral arrangement on the drum 34 as shown in FIG. 3. This promotes downstream movement of the material from the inlet zone to the retention zone in dryer housing 11.

One or more shaft mounted air dams 37 or wall mounted air dams 38 can be spaced along the length of dryer housing 11 downstream of the drum 34. The shaft mounted air dams 37 are mounted on the shaft 18 and extend radially toward but are spaced from the interior side wall of the housing 11. Hot air and subject material flow around the shaft mounted air dam away from the shaft and toward the housing side wall. The wall mounted air dams 38 are fastened to the interior side wall of housing 11. Hot air and material are diverted by the wall mounted air dam inward away from the side wall.

A plurality of retention paddles 40 are carried by paddle shafts 39 that are assembled to the central shaft 18 and are spaced along the length thereof. Paddles 40 are downstream of the drum 34. The tips of the retention paddles pass close by the interior surface of the side wall of housing 11. The retention paddles and air dams regulate the retention time of material in the dryer housing. The paddle blade angle with respect to the air flow is adjustable to promote a greater or lesser retention time of the material in the drying chamber. The retention paddles also break up the slurry material and mix it with the hot air.

Wet particulate or slurry material is introduced into the drying chamber through the inlet 15. Heated air enters through the hot air duct at the inlet end wall 14. The material is acted upon first by the agitator blades 35 on drum 34. The material does not collect on the inlet end wall. The drum does have any region for the accumulation of material where it might stagnate and eventually burn. The agitator blades break up the slurry material. The material is carried by the heated air from the inlet zone of dryer housing to the retention zone where it is acted upon by the retention paddles 40. The retention paddles are adjusted as necessary to regulate retention time of the material in the retention zone. The dried material eventually discharges through the discharge opening 43 connected to the material outlet duct 27.

Figure 6:
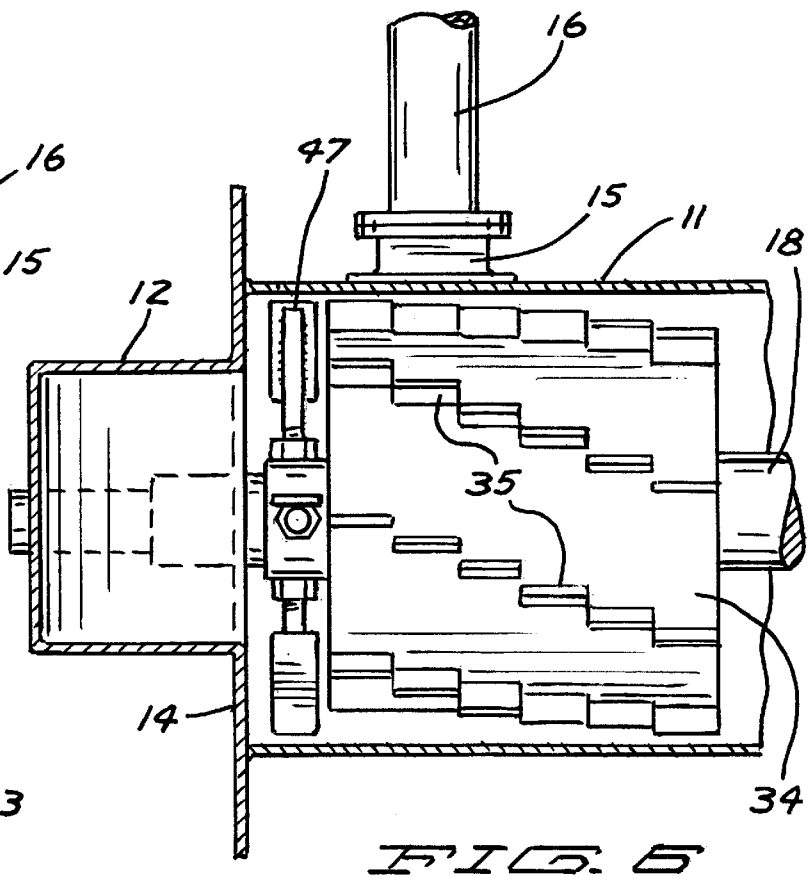
FIG. 6 is a sectional view of the upstream end of the dryer like that of FIG. 4 showing a modification.
Figure 5:
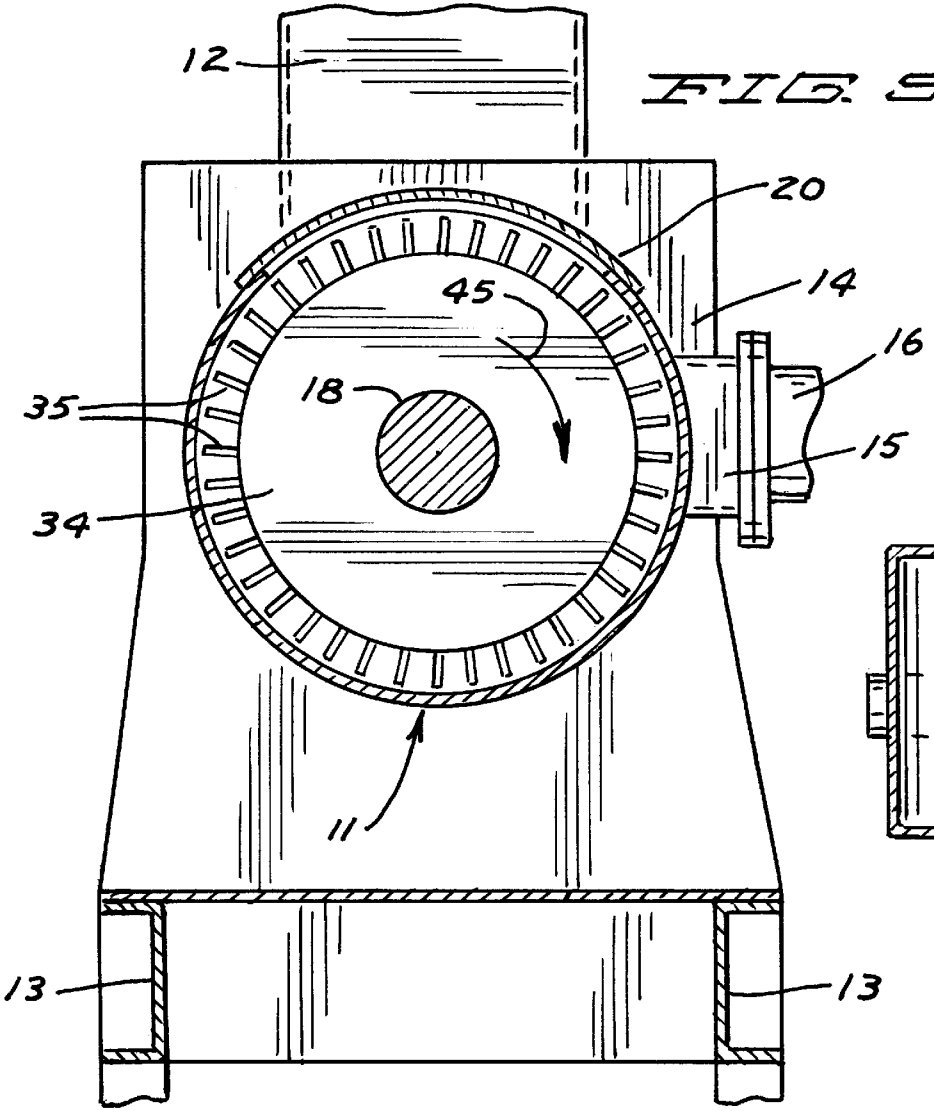
FIG. 5 is another enlarged sectional view of a portion of the dryer of FIG. 2 taken along the line 5—5 thereof.

A modification of the invention is shown in FIG. 6. A set of retention paddles 47 is mounted on shaft 18 between the drum 34 and the upstream end wall 14. The retention paddles 47 are adjusted to ensure that material entering inlet 15 moves downstream. The tips of the blades move close by the interior surface of the side wall of housing 11. The retention paddles 47 keep material away from the upstream end wall 14.

The embodiments of the invention in which an exclusive property or privilege is claimed are defined as follows:

1. A hot air dryer for drying a wet material, including:

an elongate dryer housing having a cylindrical side wall defining a drying chamber, with an upstream end and a downstream end;

an upstream end wall closing the upstream end of the housing;

a shaft mounted in the housing parallel to the longitudinal axis thereof and mounted for axial rotation in the chamber;

means for axial rotation of the shaft in the chamber;

a hot air inlet to the housing at the upstream end of the chamber;

an outlet on the housing at the downstream end of the chamber for discharge of material that has been dried by the hot air;

a material inlet pipe connected to the housing and open to the drying chamber at a material inlet opening that is located downstream of the hot air inlet so that wet material introduced into the housing will mix with the hot air introduced at the hot air inlet and move downstream toward the outlet;

means on the shaft rotatable with the shaft for mixing the hot air and wet material as it moves downstream in the chamber;

a drum mounted on the shaft near the upstream end of the housing positioned in intercepting relationship to the material inlet, said drum having a diameter substantially spanning most of the diameter of the chamber of the housing;

a plurality of individual agitator blades mounted on the surface of the drum spaced apart from one another along the circumference of the drum, positioned to sweep close by the interior side wall surface of the housing upon rotation of the shaft.

2. The dryer of claim 1 wherein:

the hot air inlet is connected to the upstream end wall.

3. The dryer of claim 2 wherein:

the means on the shaft for mixing the hot air and wet material includes a plurality of retention paddles mounted on the shaft, said paddles having tips that pass close by the interior side wall of the housing upon rotation of the shaft.

4. The dryer of claim 3 including:

at least one wall mounted air dam fixed to the interior side wall surface of the housing.

5. The dryer of claim 3 including:

at least one shaft mounted air dam fixed to the shaft.

6. The dryer of claim 1 wherein:

the agitator blades are mounted in a spiral pattern on the drum.

7. The dryer of claim 1 wherein:

the means on the shaft for mixing the hot air and the wet material includes a plurality of retention paddles mounted to the shaft downstream of the drum, said paddles having tips that pass close by the interior side wall surface of the housing upon rotation of the shaft.

8. The dryer of claim 7 including:

at least one wall mounted air dam fixed to the interior side wall surface of the housing.

9. A hot air dryer for drying a wet material, including:

an elongate dryer housing having a cylindrical side wall defining a drying chamber, with an upstream end and a downstream end;

an upstream end wall closing the upstream end of the housing;

a shaft mounted in the housing parallel to the longitudinal axis thereof and mounted for axial rotation in the chamber;

means for axial rotation of the shaft in the chamber;

a hot air inlet to the housing connected to the upstream end wall at the upstream end of the chamber;

an outlet on the housing at the downstream end of the chamber for discharge of material that has been dried by the hot air;

a material inlet pipe connected to the housing and open to the drying chamber at a material inlet opening that is located downstream of the hot air inlet so that wet material introduced into the housing will mix with the hot air introduced at the hot air inlet and move downstream toward the outlet;

means on the shaft rotatable with the shaft for mixing the hot air and wet material as it moves downstream in the chamber;

a drum mounted on the shaft near the upstream end of the housing positioned in intercepting relationship to the material inlet, said drum having a diameter substantially spanning most of the diameter of the chamber of the housing;

a plurality of individual agitator blades mounted on the surface of the drum positioned to sweep close by the interior side wall surface of the housing upon rotation of the shaft; and a plurality of paddles mounted on the shaft between the upstream end of the drum and the upstream end wall of the housing.

10. The dryer of claim 9 wherein:

said agitator blades are mounted on the drum in a spiral pattern.

11. A hot air dryer for drying a wet material, including:

an elongate dryer housing having a cylindrical side wall defining a dryer chamber, with an upstream end and a downstream end;

an upstream end wall closing the upstream end of the housing;

a shaft mounted in the housing parallel to the longitudinal axis thereof and mounted for axial rotation in the chamber;

means for rotation of the shaft in the chamber;

a hot air inlet to the housing at the upstream end of the chamber;

an outlet on the housing at the downstream end of the chamber for discharge of material that has been dried by the hot air;

a material inlet to the housing open to the chamber toward the upstream end thereof for introduction of wet material into the drying chamber;

a drum mounted to the shaft near the upstream end of the housing, said drum having a diameter substantially spanning most of the diameter of the chamber of the housing;

a plurality of individual agitator blades mounted on the surface of the drum spaced apart from one another along the circumference of the drum, positioned to sweep close by the interior side wall surface of the housing upon rotation of the shaft; and a plurality of retention paddles mounted on the shaft downstream of the drum having blades with tips that sweep close by the interior side wall surface of the housing upon rotation of the shaft.

12. The dryer of claim 11 wherein:

the agitator blades are mounted in a spiral pattern on the drum.

* * * * *